US010343878B2

(12) United States Patent
Limb

(10) Patent No.: US 10,343,878 B2
(45) Date of Patent: Jul. 9, 2019

(54) POWERED WINCH RETRIEVAL SYSTEM FOR HARVESTED BIG GAME

(71) Applicant: Andrew J Limb, West Jordan, UT (US)

(72) Inventor: Andrew J Limb, West Jordan, UT (US)

( * ) Notice: Subject to any disclaimer, the term of this patent is extended or adjusted under 35 U.S.C. 154(b) by 172 days.

(21) Appl. No.: 15/430,947

(22) Filed: Feb. 13, 2017

(65) Prior Publication Data

US 2018/0229982 A1 Aug. 16, 2018

(51) Int. Cl.

| | |
|---|---|
| ***B66D 1/18*** | (2006.01) |
| ***B66D 1/20*** | (2006.01) |
| ***B66D 1/38*** | (2006.01) |
| ***B66D 5/08*** | (2006.01) |
| ***B66D 1/28*** | (2006.01) |

(52) U.S. Cl.

CPC ..... *B66D 1/18* (2013.01); *B66D 1/20* (2013.01); *B66D 1/28* (2013.01); *B66D 1/38* (2013.01); *B66D 5/08* (2013.01)

(58) Field of Classification Search

CPC ... B66D 1/18; B66D 1/20; B66D 1/38; B66D 1/7447; B66D 5/14

See application file for complete search history.

(56) References Cited

U.S. PATENT DOCUMENTS

| | | | | | |
|---|---|---|---|---|---|
| 3,291,452 | A * | 12/1966 | Rau | B66D 5/32 | 188/82.5 |
| 3,309,066 | A * | 3/1967 | Carlson | B66D 1/22 | 242/390.9 |
| 4,102,440 | A * | 7/1978 | Wood | F16D 65/18 | 188/72.7 |
| 4,145,028 | A * | 3/1979 | Kelley | B66D 1/00 | 224/263 |
| 4,588,167 | A * | 5/1986 | Finzel | B66D 1/00 | 254/346 |
| 5,273,257 | A * | 12/1993 | Perkins | B66D 1/18 | 254/323 |

* cited by examiner

*Primary Examiner* — Sang K Kim
*Assistant Examiner* — Nathaniel L Adams
(74) *Attorney, Agent, or Firm* — Angus C. Fox, III

(57) ABSTRACT

The present invention provides a powered winch retrieval system for harvested big game that can be configured either as a small trailer attachable to a vehicle via a hitch, or as a cantilevered unit couplable to a standard vehicle receiver hitch. The winch incorporates a frame that supports an internal combustion engine having a centrifugal clutch or constant velocity transmission (CVT) mounted thereon, a jack shaft chain driven by the centrifugal clutch or CVT for speed reduction and torque amplification, an output shaft on which is mounted a cable take-up spool, a norm ally-on disc brake assembly mounted on the final output shaft, a combination brake release and throttle lever, and an optional oscillating level-wind assembly. The level-wind assembly, which incorporates a linear ball-bearing bushing, ensures that the cable used to retrieve harvested game winds evenly on the take-up spool.

14 Claims, 8 Drawing Sheets

210
209
204
201
206
205
207-A
207-B
207-C
140
138
102
202
103
208
203
107
104
108
110
113
112
119
114
139
115
134
133
132
131
130
137
111
118
116-L
136-U
116-R
141
126
124
120
123-L
128
129
122-R
122-L
123-R
121
135
117
200

POWERED WINCH RETRIEVAL SYSTEM FOR HARVESTED BIG GAME

BACKGROUND OF THE INVENTION

1. Field of the Invention

This invention relates to power winches and, more particularly, to power winches used to drag harvested large game from a first location at a lower elevation to a second location at a higher elevation.

2. History of the Prior Art

Numerous situations arise in which it is necessary or desirable to lift or move a heavy object. Various devices have been previously developed, of course, as aids in lifting or moving heavy objects. Included in a listing of such devices are winches of various types and descriptions.

A winch is a mechanical device used to wind or unwind cable or wires. The winch is, in its simplest form, a spool with an attached hand crank. Most modern winches are powered by electric, hydraulic or pneumatic motors or by internal combustion engines. Power is frequently applied to the winch through a gear reduction drive. In addition, many winches include a braking system, which enables the winch to be secured in a stationary position during either the winding or unwinding process.

There are many potential uses for a power winch in remote locations. For example, a power winch can be extremely useful in the field for moving timber, or towing a vehicle out of mud, snow or water, or moving large game animals which have been killed while hunting.

Winches are frequently mounted on the front of pickup trucks designed for off-road use. It is envisioned that such winches will be used to extricate the vehicle from situations where it is stuck and unable to move under its own power. Extrication of the vehicle can be accomplished by unwinding the cable on the winch, attaching the free end of the cable to an immovable object, such as a tree, and then winding up the cable and pulling the vehicle toward the immovable object.

For retrieval of harvested big game, pickup trucks may be too large, too heavy and insufficiently maneuverable to drive to a location where a winch is required, thereby rendering a winch mounted thereon useless.

SUMMARY OF THE INVENTION

The present invention provides a Powered Winch Retrieval System for Harvested Game that can be configured either as a small trailer attachable to a vehicle via a hitch, or as a cantilevered unit couplable to a standard vehicle receiver hitch. The winch incorporates a frame that supports an internal combustion engine having a centrifugal clutch, a jack shaft chain driven by the centrifugal clutch for speed reduction and torque amplification, an output shaft on which is mounted a cable take-up spool, a normally-on disc brake assembly mounted on the final output shaft, a combination brake release and throttle lever, and an optional level-wind assembly.

For a first embodiment of the invention, a 10-tooth sprocket on the centrifugal clutch drives a first 70-tooth sprocket on the jack shaft via a first #40 roller chain; a 12-tooth sprocket on the jack shaft drives a second 70-tooth sprocket on the output shaft via a second #40 roller chain; and a second 12-tooth sprocket drives a 60-tooth sprocket on a grooved shaft that is part of a level-wind assembly. The grooved shaft incorporates superimposed right and left-hand spiral grooves over most of its length. Near each end of the shaft, the right and left-hand grooves are interconnected by a direction reversal loop. An oscillating level-wind tracking mechanism incorporates a rotatable cylindrical groove follower having a blade that continuously tracks the spiral grooves of the grooved shaft so that the level-wind tracking mechanism moves back and forth along the grooved shaft as it first follows the right-hand spiral, then the left-hand spiral, then the right-hand spiral, and so forth. The level-wind-tracking mechanism is equipped with a linear ball bearing that rides on a cylindrical guide shaft that is parallel to the grooved shaft. The level-wind tracking mechanism also incorporates a cable guide moves the winch cable back and forth at a controlled rate that is proportional to the rotational speed of the grooved shaft. The linear ball bearing prevents binding of the follower on the guide shaft when side loads are imposed on the cable guide. The Cam Operated Disc Brake unit of U.S. Pat. No. 4,102,440 has been incorporated into the is disc brake unit. The disc brake prevents the take-up spool from rotating when the spool is not being driven by the engine. Thus, the brake is applied and prevents the output shaft from rotating whenever the centrifugal clutch in disengaged. Braking force applied to the output shaft is provided by a spring, the tension of which is adjustable with a thumb-nut. The combination brake release and throttle lever, when moved forward, moves a cam, or actuator wedge, so that it releases the disc brake. Forward movement of the lever also increases the throttle setting of the engine's carburetor, which causes the engine to speed up and engage the centrifugal clutch, thereby winding the winch cable onto the take-up spool.

An alternative embodiment of the invention has been made more compact by eliminating the level-wind assembly. This embodiment is shown with a two-piece sliding coupler that enables the cable take-up spool to be decoupled from the transmission. When the right member of the coupler is loosened and slid to the right on the take-up shaft, the take-up spool can rotate freely about the take-up shaft. This is advantageous when it is necessary to unwind the cable from the spool. After the free end of the cable has been secured to a load, the right member of the coupler can be slid to the left so that it engages the left member of the coupler. A securing screw ensures that the right member remains coupled to the left member. A brake release and throttle control lever on the alternative embodiment functions in an identical manner as that on the first embodiment of the powered winch retrieval system.

DETAILED DESCRIPTION OF THE PREFERRED EMBODIMENT

The invention will now be described with reference to the attached drawing figures. It should be understood that the drawings are not necessarily drawn to scale and are intended to be merely illustrative of the invention. It should be further understood that because of the gargantuan task of drawing every chain link and every sprocket tooth, the sprockets and roller chains are shown in schematic format. As the sprockets and roller chains are generic items, and no specific features of these components are called out in the claims, this should be considered an enabling disclosure. In addition, although for the preferred embodiment of the invention, all of the various shafts preferably run in sealed ball-bearing assemblies, each of the bearings in FIGS. 1, 2 and 3 is shown schematically as a bearing cap secured to a supporting post with a pair of bolts.

Figure 1:
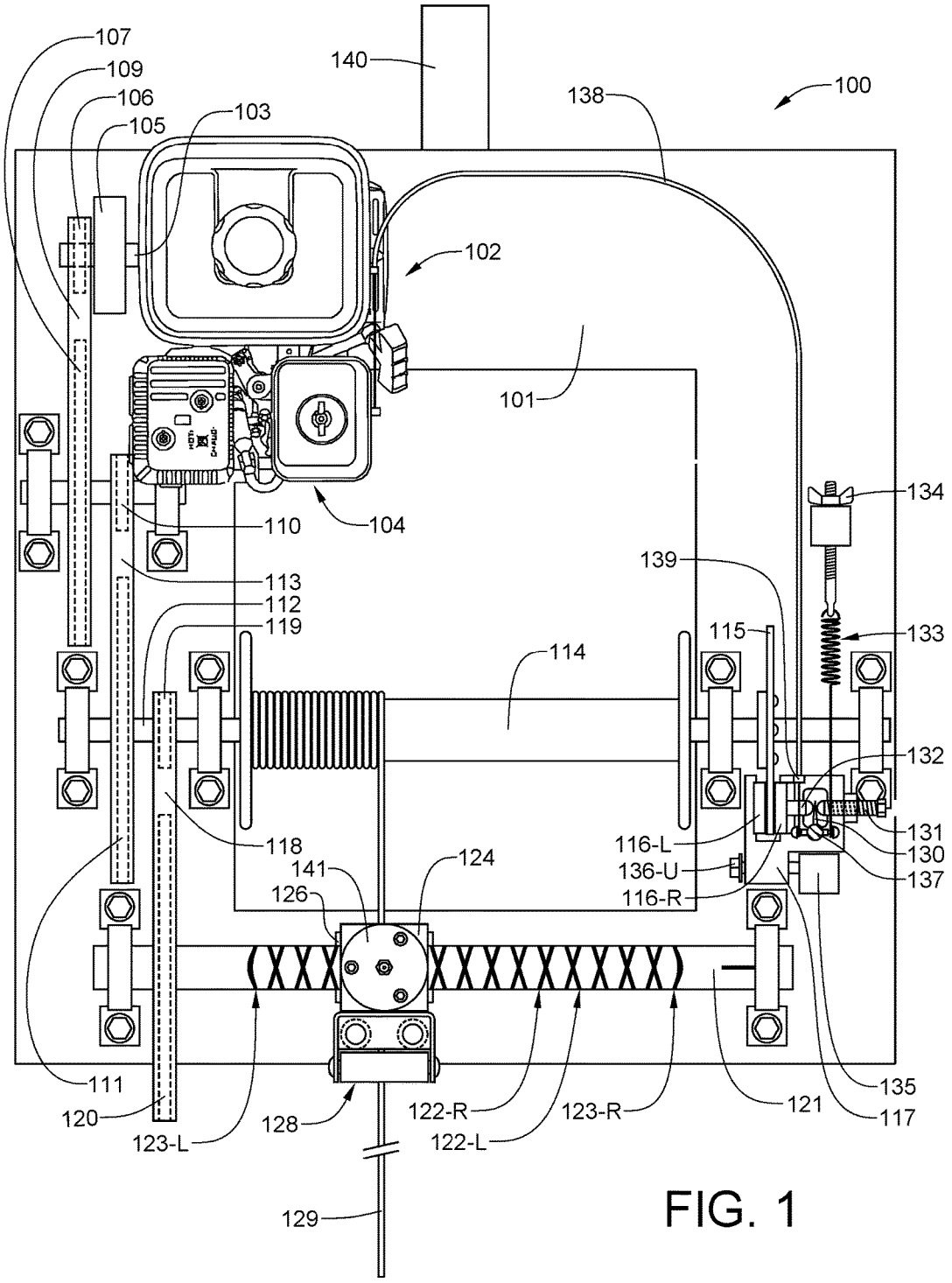
FIG. 1 is a top plan schematic view of a first embodiment Powered Winch Game Retrieval System that employs a centrifugal clutch secured to the engine output shaft.

Referring now to FIG. 1, a first embodiment powered winch game retrieval system 100 incorporates a frame 101 that supports a single-cylinder internal combustion engine 102 having an output shaft 103 and a carburetor 104. A centrifugal clutch 105, which is equipped with a 10-tooth drive sprocket 106, is mounted on the engine output shaft 103. The drive sprocket 106 transmits power of the engine to a first 70-tooth sprocket 107 that is affixed to a jack shaft 108 via a first #40 roller chain 109. Power is transmitted from a first 12-tooth sprocket 110, which is also affixed to the jack shaft 108, to a second 70-tooth sprocket 111, mounted on a take-up shaft 113, via a second #40 roller chain 113. The take-up shaft 112 rotates at 0.0245 times the speed of the engine output shaft 103, which equates to a significant amplification of engine torque output. A cable take-up spool 114 and a disk brake rotor 115 are rig idly affixed to the take-up shaft 113. The brake rotor 115 is sandwiched between the brake pads 116-L and 116-R mounted with a disk brake caliper body 117, which is affixed to the frame 101. The brake, consisting of the brake rotor 115 and the brake caliper body 117, are in a normally ON state, which prevents the take-up spool from rotating when the centrifugal clutch 105 is not engaged, and the engine is not providing power to the take-up spool 114. Via a third #40 roller chain 118, a second 12-tooth sprocket 119 affixed to the take-up shaft 112 drives a 60-tooth sprocket 120 on a grooved shaft 121 that is part of a level-wind assembly. The grooved shaft 121 incorporates a right-hand spiral groove 122-R that is superimposed on a left-hand spiral groove 122-L over most of its length. Near each end of the grooved shaft 121, the right and left-hand grooves are interconnected by a direction reversal loop 123-L and 123-R. An oscillating level-wind tracking mechanism 124 has a cylindrical chamber (not shown) covered by a bolt-on circular cap 141 in which a cylindrical, axially-rotatable groove follower 125 (see FIG. 4) is installed. The groove follower 125 is shimmed or spring loaded so that it continuously tracks the spiral grooves 122-L and 122-R of the grooved shaft 121, thereby causing the level-wind tracking mechanism 124 to move back and forth along the grooved shaft 121 as it first follows the right-hand spiral groove 122-R, then the left-hand spiral groove 122-L, then, again, the right-hand spiral groove 122-R, and so forth. The level-wind tracking mechanism 124 is equipped with a linear ball-bearing bushing 126 (as a replacement for a plain bearing or bearing) that rides on a cylindrical guide shaft 127 (see FIG. 3) that is parallel to the grooved shaft 121. The linear ball-bearing bushing 126 will be subsequently described in detail with reference to FIG. 5. The cylindrical guide shaft 127 is made of hardened steel that is copper plated and, then, subsequently chrome plated. The linear motion ball-bearing bushing (also called a linear motion ball bushing or shaft guide) 126 is partially visible in FIGS. 1, 2 and 3, and fully visible in FIG. 5 prior to installation in the level-wind tracking mechanism 124. The linear motion ball-bearing bushing 126 provides low-friction movement of the level-wind tracking mechanism back and forth on the cylindrical guide shaft 127. The level-wind tracking mechanism 124 also incorporates a cable guide 128, that moves a winch cable 129 back and forth at a controlled rate, that is proportional to the rotational speed of the grooved shaft 120, as the winch cable 129 is wound onto the take-up spool 114.

Still referring to FIG. 1, the Cam Operated Disc Brake unit of U.S. Pat. No. 4,102,440 has been incorporated into the is disc brake unit of the present invention. Pressure of the brake pads 116 against the brake rotor 115 is provided by a brake pad actuator wedge 130 that is driven between an adjustable fixed post 131 in the caliper body 117 and a slidable post 132 within the caliper body 117 that contacts the right brake pad 116-R, by a coil spring 133 that is under tension. Tension on the spring 133 can be adjusted with a thumb-nut 134. The caliper body 117 is slidably mounted to a square post 135 that is affixed to the frame 101 with a pair of caliper securing bolts 136-U and 136-L (only caliper securing bolt 136U is visible in FIG. 1). A combination throttle and brake-release lever 137 is coupled to the brake pad actuator wedge 130. When the lever 137 is pulled rearward, the brake pad actuator wedge 130 is pulled from between the fixed post 131 and the slidable post 132, thereby releasing the brake and allowing the take-up shaft 112 and take-up spool 114 to rotate. Simultaneous with release of the brake, the throttle setting is increased via a Bowden throttle cable 138, which causes the engine to speed up and engage the centrifugal clutch 105, thereby winding the winch cable 129 onto the take-up spool. A cable housing anchor 139 is rigidly affixed to the caliper body 117. A hitch tube 140 of 2-inch square cross section fits into a standard 2-inch hitch receiver installed on a vehicle.

Figure 2:
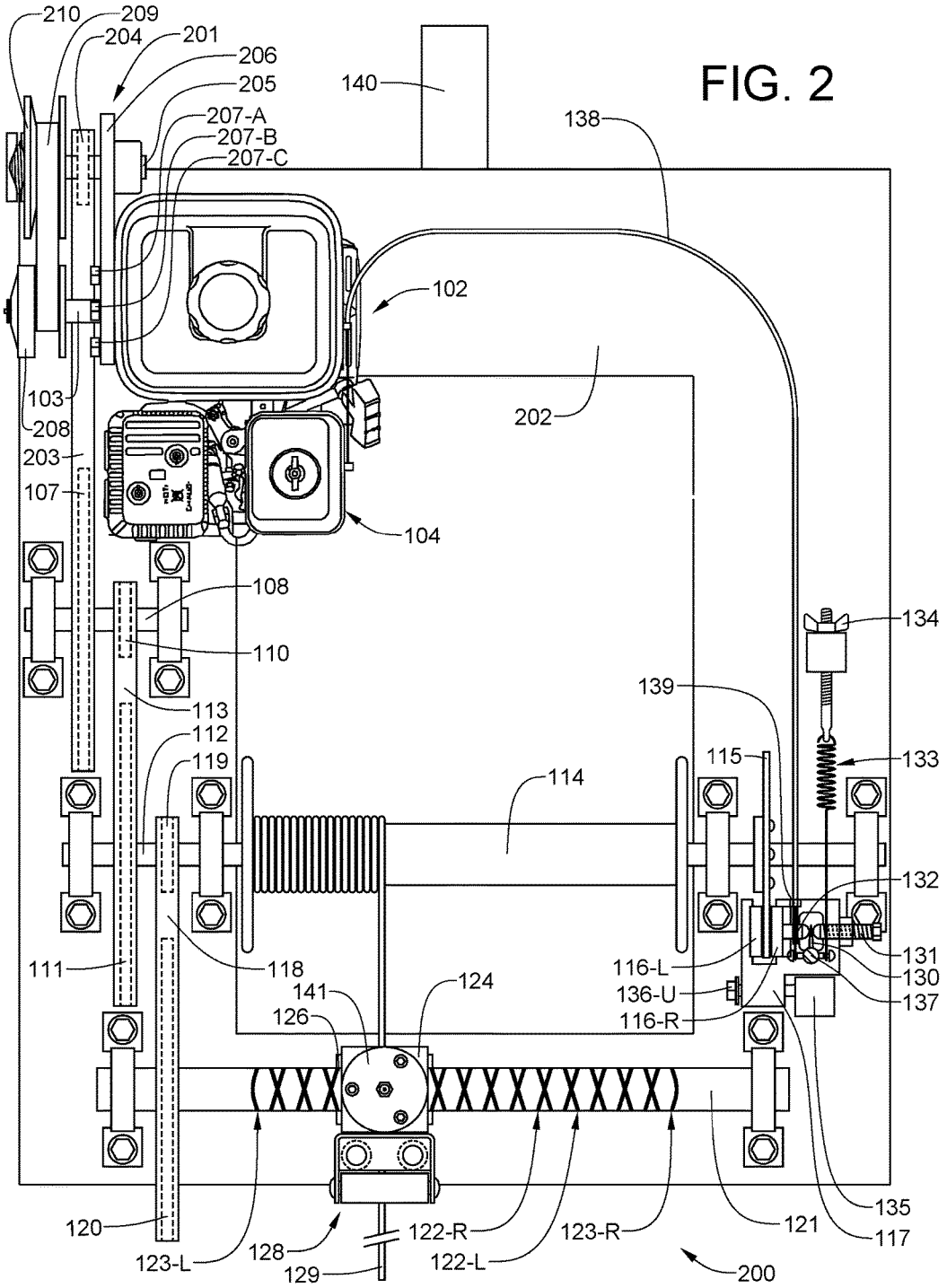
FIG. 2 is a top plan schematic view of a second embodiment Powered Winch Game Retrieval System that employs a continuously-variable transmission in place of the centrifugal clutch of the first embodiment system.
Figure 3:
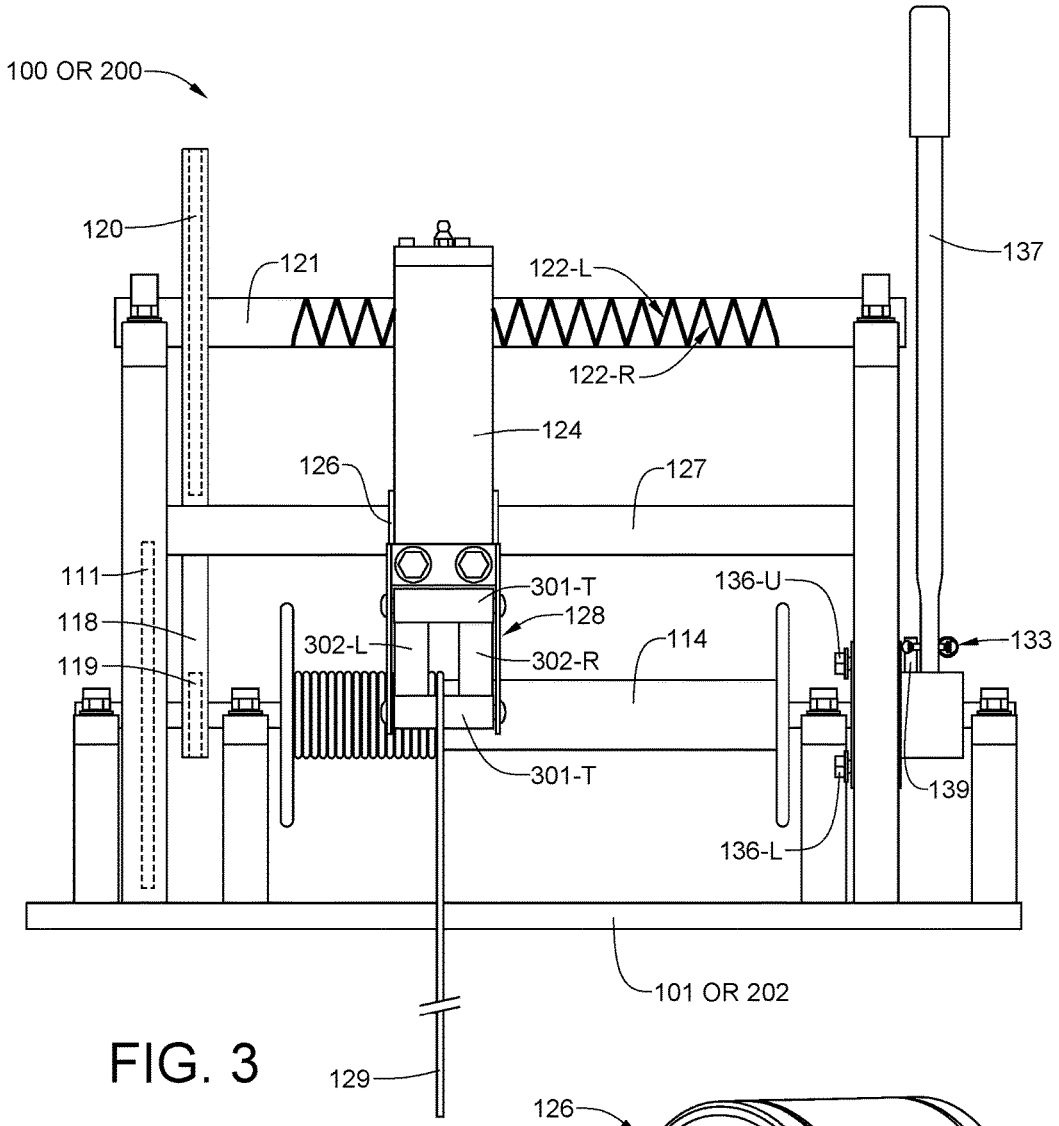
FIG. 3 is a partial front elevational schematic view of the Powered Winch Game Retrieval System, showing only the output shaft and level-wind assembly of either the first or second embodiment system.

Referring now to FIG. 2, a second embodiment powered winch game retrieval system 200 is essentially identical to the first embodiment system 100, with the exception that the centrifugal clutch 105 of the first embodiment powered winch retrieval system 100 has been replaced with a continuously variable transmission (CVT) 201 that also incorporates a clutch. Because the CVT 201 requires greater space for installation, a longer frame 202 replaces the frame 101 of the first embodiment system 100. It will be noted that the power take-off is at the rear of the engine 102. The only other significant change is that the first roller chain 203 (item 109 of the first embodiment system 100) has been lengthened somewhat because the distance between the 10-tooth sprocket 204 on the output shaft 205 of the CVT 201 and the first 70-tooth sprocket 107 of the second embodiment system 200 is longer than the distance between the 10-tooth sprocket 204 and the first 70-tooth sprocket 107 of the first embodiment system 100. The CVT 201 has a transmission unit support bracket 206 that is bolted to the engine with four bolts 207-A, 207-B, 207-C and 207-D that surround the engine output shaft 103. Only three of the four bolts are visible in this view, as bolt 207-D is positioned directly below bolt 207-B. The engine output shaft 103 protrudes through the transmission support bracket 206 and is coupled to a centrifugally-adjustable pulley 208. A drive belt 209 couples the centrifugally-adjustable pulley 208 to a normally-large-diameter, spring-loaded driven pulley 210 mounted on the transmission output shaft 205. As engine speed increases, the width of the centrifugally-adjustable pulley 208 narrows, causing its effective diameter to increase. The normally-large-diameter, spring-loaded driven pulley 210 automatically reduces its diameter to compensate for the reduced amount of drive belt available at the transmission output shaft 205. These changes in pulley size tend to maintain engine speed within a desired torque and power band. If, for example, load were to increase on the take-up spool 114, engine speed would be drop, causing the centrifugally-adjustable pulley 208 to widen, thereby effectively lowering the gear ratio, reducing the rotational speed of the take-up shaft 112, and boosting engine speed to near its previous value. A spring-loaded centrifugal clutch, which positioned on the transmission output shaft 205 along with the driven pulley 210, enables the 10-tooth sprocket 204 to remain stationary until the driven pulley 210 achieves a set rotational speed, thereby coupling the driven pulley 210 to the 10-tooth sprocket 204.

Referring now to FIG. 3, this drawing of the shows only the output shaft and level-wind assembly of either the first or second embodiment of the powered winch game retrieval system 100 or 200. The cable guide 128 incorporates a pair of horizontal rollers 301-T and 301-B, as well as a pair of vertical rollers 302-L and 302-R. The vertical and horizontal rollers minimize abrasion of the winch cable 129. In this view, the combination throttle and brake-release lever 137 is shown in its entirety, except for the bottom end thereof, which is pivotally mounted within the brake caliper body 117 and coupled to the brake pad actuator wedge 130.

Figure 4:
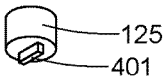
FIG. 4 is an isometric view of the axially rotatable groove follower.

Referring now to FIG. 4, the groove follower 125 is shown for the first time. The groove follower 125 incorporates a groove follower blade 401 at the bottom end thereof. The cap 141 (see FIGS. 1 and 2) on the top of the level-wind tracking mechanism 124 secures the groove follower 125 within the cylindrical chamber within the level-wind tracking mechanism 124. The groove follower 125 can be made to follow the grooves 122-R and 122-L on cylindrical guide shaft 127 by placing either shims or a spring under compression in the cylindrical chamber above the groove follower 125.

Figure 5:
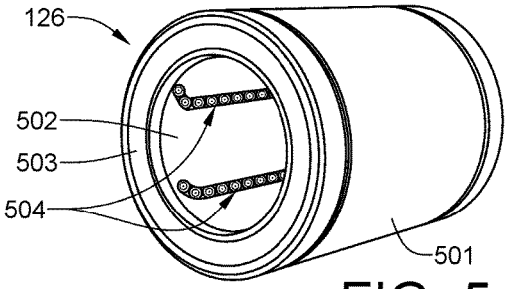
FIG. 5 is an enlarged perspective view of the six-ball-bearing row, linear motion ball-bearing bushing used in the level-wind assembly of FIG. 3.

The linear motion ball-bearing bushing 126 will now be described in detail, with reference to FIG. 5. The linear motion ball-bearing bushing 126 consists of a generally cylindrical outer shell 501 with polymeric cage 502 in which are set six longitudinal raceway segments 504 made of hardened steel to guide the ball sets within the complete system. Recirculating balls within the raceway segments provide unlimited stroke and low friction movement of the level-wind tracking mechanism 124 on the cylindrical guide shaft 127. The linear motion ball-bearing bushing 126 prevents binding of the level-wind tracking mechanism 124 on the cylindrical guide shaft 127 when side loads are imposed on the cable guide 128. The ball-bearing bushing 126 is equipped with grease seals 503 at both ends (only one seal is visible in this view).

Figure 8:
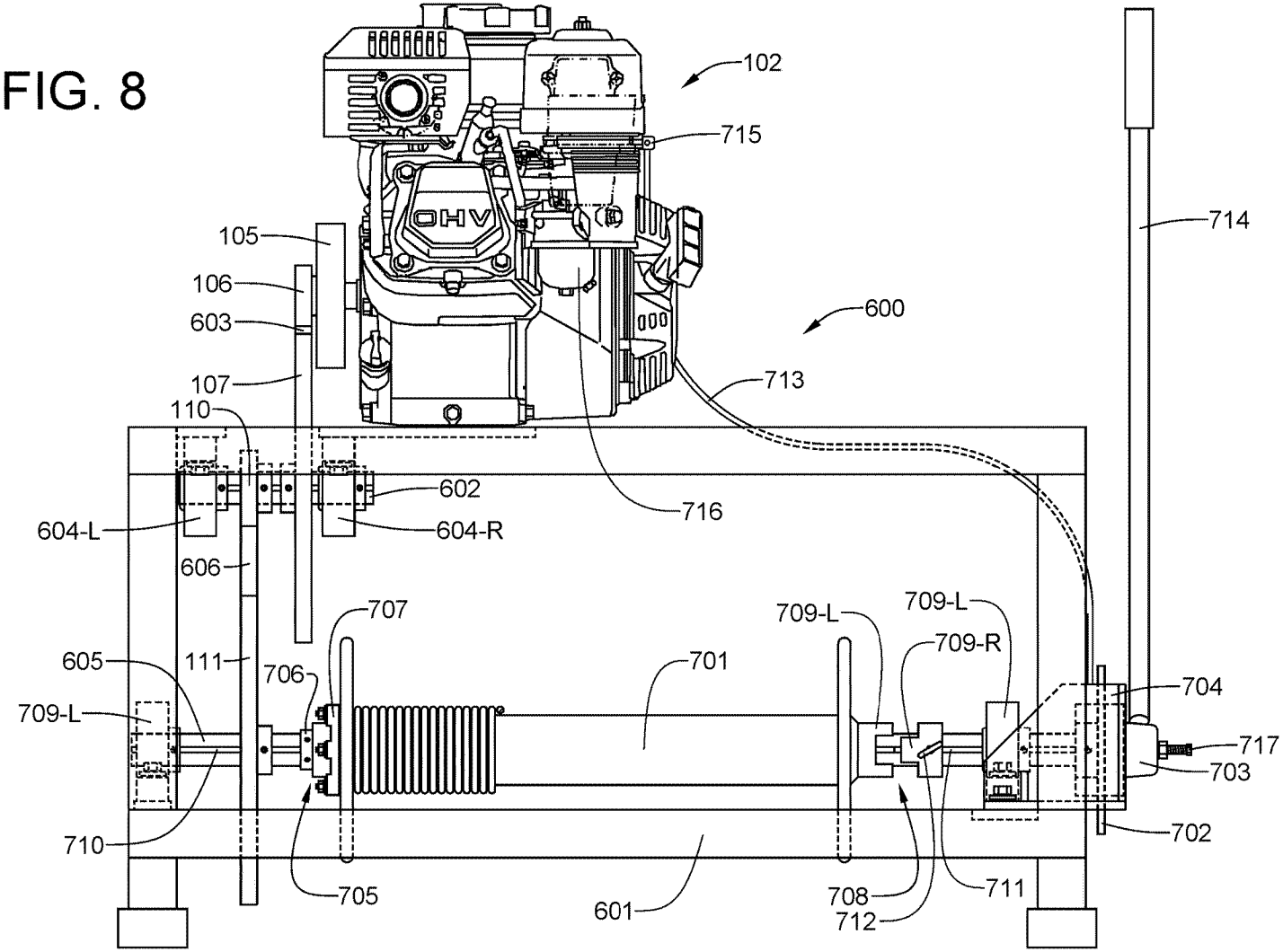
FIG. 8 is a front elevational view of the third embodiment Powered Winch Game Retrieval System of FIG. 6, without the cable guides installed and the drive coupler disengaged so that the take-up spool is decoupled from the engine.
Figure 9:
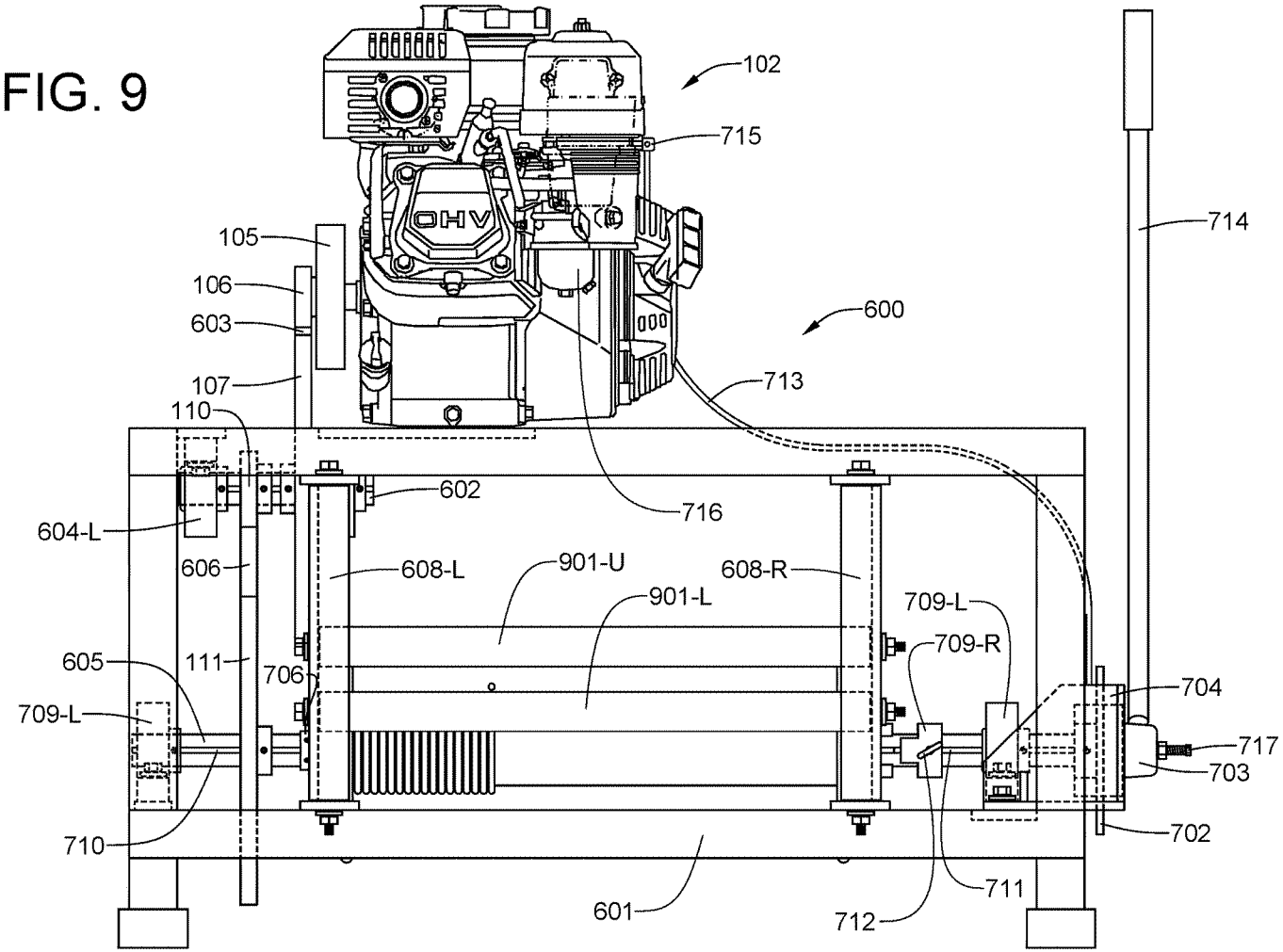
FIG. 9 is a front elevational view of the third embodiment Powered Winch Game Retrieval System of FIG. 6, with the cable guides installed and the drive coupler disengaged so that the take-up spool is decoupled from the engine.
Figure 10:
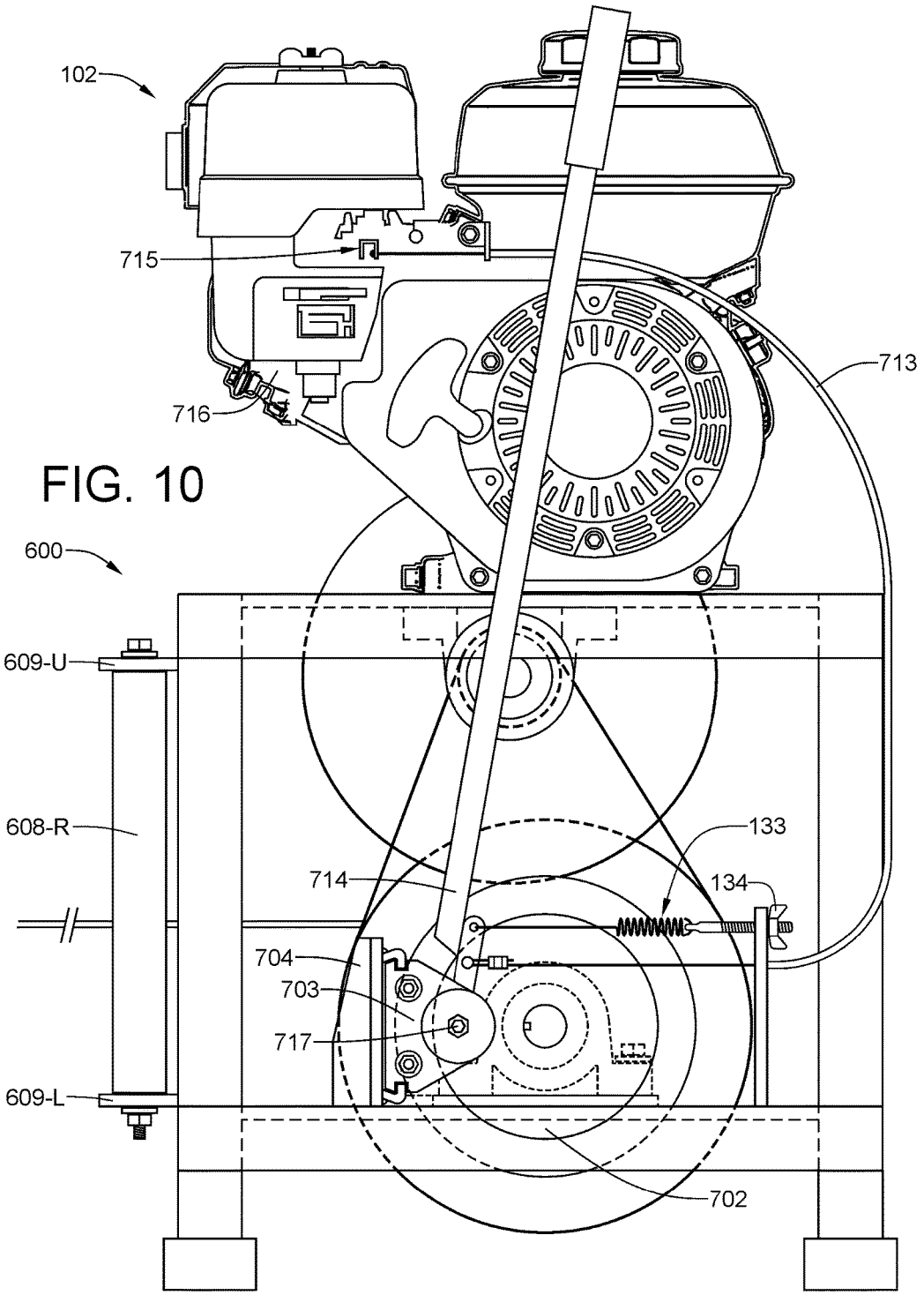
FIG. 10 is a right-side elevational view of the third embodiment Powered Winch Game Retrieval System of FIG. 6.

FIGS. 6, 7, 8, 9 and 10 depict a more compact embodiment 600 of the Retreival System that deletes the level-wind mechanism. A coupler allows the cable takeup spool to be released from the drive train so that sprockets and chains need not move when the cable is pulled from the spool. The coupler, the spool and the brake mechanism can be seen in FIGS. 7, 8 and 9. The brake and throttle control mechanism is best seen in FIG. 10.

Figure 6:
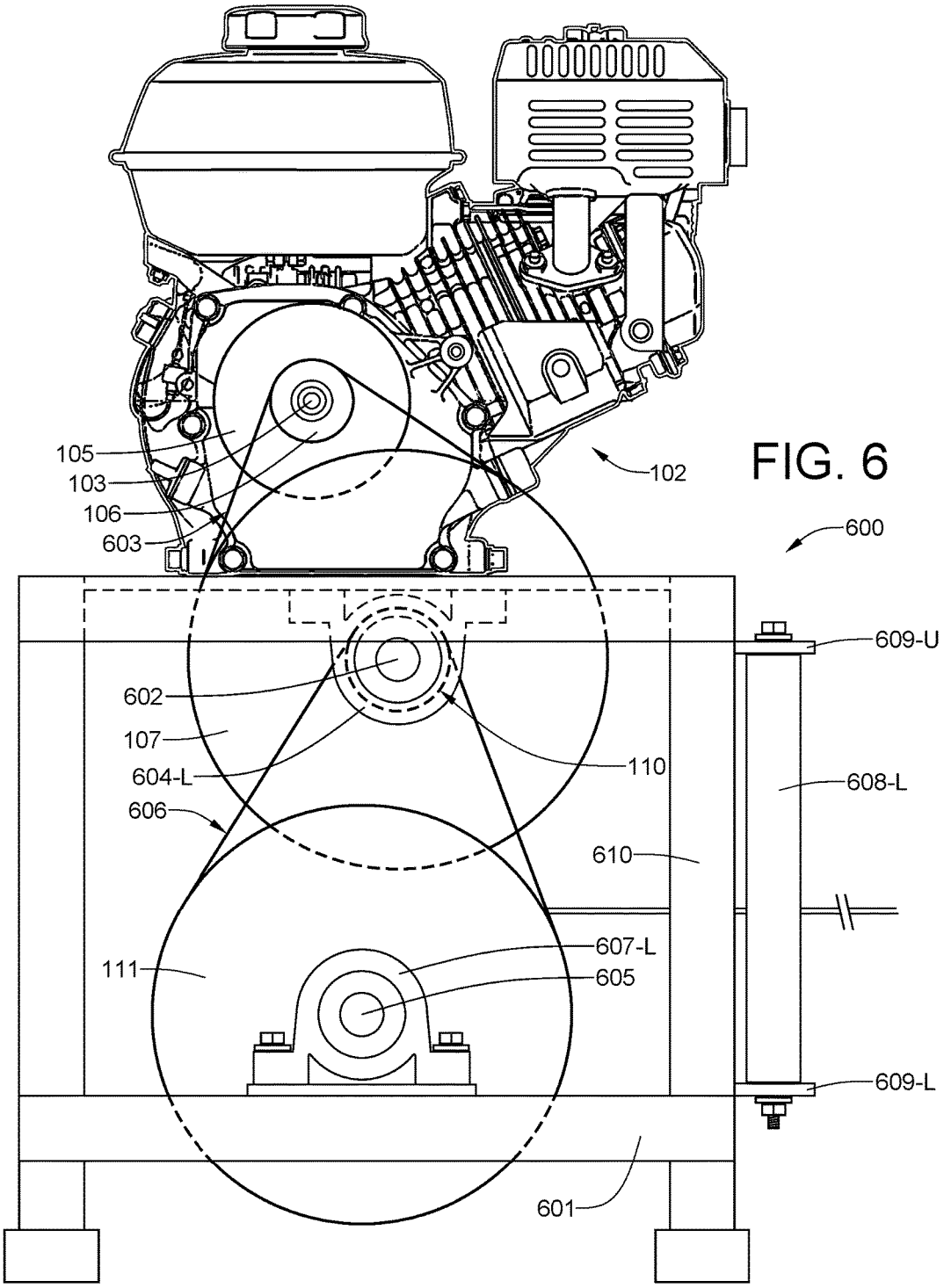
FIG. 6 is a left-side elevational view of a compact third embodiment Powered Winch Game Retrieval System that eliminates the level-wind assembly of the first and second embodiment systems.

Referring now to FIG. 6, the alternative embodiment of the powered winch game retrieval system 600 incorporates a two-tier frame 601 that supports an internal combustion engine 102 having an output shaft 103 on the top tier. A centrifugal clutch 105, which is equipped with a 10-tooth drive sprocket 106, is mounted on the engine output shaft 103. The drive sprocket 106 transmits power of the engine to a first 70-tooth sprocket 107 that is affixed to a jack shaft 602 via a first #40 roller chain 603. The jack shaft 602 is supported by a first pair of left and right ball-bearing assemblies 604-L and 604-R (Only assembly 604-L is visible in FIG. 6). Power is transmitted from a first 12-tooth sprocket 110, which is also affixed to the jack shaft 602, to a second 70-tooth sprocket 111, mounted on a take-up shaft 605, via a second #40 roller chain 606. The take-up shaft 605, which is supported by a second pair of left and right ball-bearing assemblies 607-L and 607-R (only 607-L is visible in this view), rotates at 0.0245 times the speed of the engine output shaft 103, which equates to a significant amplification of engine torque output. A pair of vertically-oriented cable guide rollers 608-L and 608-R are rotatably secured to the frame 601 with upper and lower brackets 609-U and 609-L, respectively (only guide roller 608-L is visible in FIG. 6). A pair of horizontally-oriented cable guide rollers are hidden by the left front vertical member 610 of frame 601 in this view, but are visible in FIG. 9.

Figure 7:
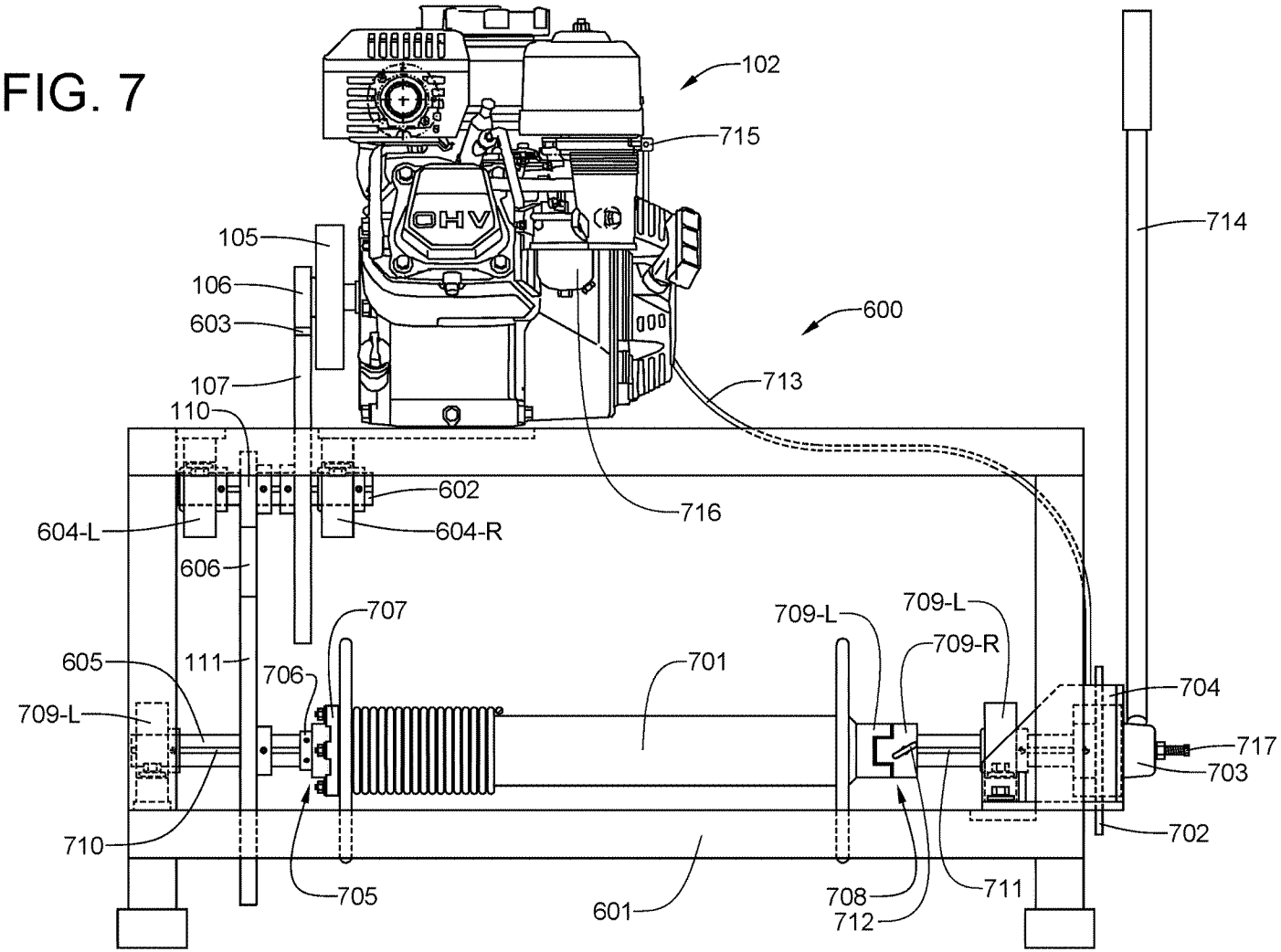
FIG. 7 is a front elevational view of the third embodiment Powered Winch Game Retrieval System of FIG. 6, without the cable guides installed and the drive coupler engaged so that the take-up spool rotates as the engine output shaft rotates.

Referring now to FIGS. 7, 8 and 9, a cable take-up spool 701 and a disk brake rotor 702 are mounted on the take-up shaft 605. The brake rotor 702, which is rigidly affixed to the take-up shaft 605, is also sandwiched between the brake pads of a disk brake caliper body 703, which is slidably mounted within a brake mounting bracket 704 that is bolted to the frame 601. The take-up spool 701 is rotatably mounted on the take-up shaft 605. A ball bearing assembly 705 has an inner race 706 that is secured to the take-up shaft 605 and an outer race 707 that is bolted to the take-up spool 701. A two-piece sliding coupler 708 has a left component 709-L that is affixed to the take-up spool 701 and rotates freely around the take-up shaft 605. There is no key in the key groove 710 beneath the left component 709-L. The sliding coupler 708 also has a right component 709-R slidable on the take-up shaft 605 along a key 711 installed within the key groove 710 within the take-up shaft 605. The right coupler component 709-R enables the take-up spool 701 to be either coupled to or decoupled from the drive train. Even when running at idle, the engine is decoupled from the drive train or transmission (which consists of sprockets and roller chains). When additional throttle is applied, the centrifugal clutch engages the drivetrain. When the right component 709-R of the coupler is loosened and slid to the right on the take-up shaft 605, the take-up spool 701 can rotate freely about the take-up shaft 605. This is advantageous when it is necessary to unwind the cable from the spool. After the free end of the cable has been secured to a load, the right component 709-R of the coupler can be slid to the left so that it engages the left component 709-L of the coupler 708. A finger-tightenable securing screw 712 ensures that the right component 709-R remains engaged with the left member 709-L. A Bowden cable 713 is employed to interconnect the master control lever 714 and the throttle control lever 715 of the carburetor. Only the float bowl 716 of the engine's carburetor is visible in this view. The adjustable fixed post 717 is threaded into the brake caliper body 703.

Referring now to FIG. 9 specifically, this drawing figure shows both the pair of vertically-oriented, left and right cable guide rollers 607-L and 607-R, respectively, and the pair of horizontally-oriented upper and lower cable guide rollers 901-U and 901-L, respectively. They were not shown in FIGS. 7 and 8 because they hide many details of the drive train and the sliding coupler 705 that are shown in those drawing figures.

Referring now to FIG. 10, the compact alternative embodiment of the powered winch retrieval system for harvested big game is seen from the right side. In this view, the brake rotor 702, the brake caliper body 703, the adjustable fixed post 717 for setting the pressure of the brake pads against the rotor when the brake is applied, and the master control lever 714 are also visible in this view. Also visible is the outer edge of the right flange of the take-up spool 701, the right vertically-oriented cable guide roller 608-R, the upper and lower mounting brackets 609-U and 609-L, respectively, for that guide roller, the coil spring 133 that returns the master control lever 714 to the brake-applied position, the thumb-nut 134 that adjusts tension on the coil spring 133, and the Bowden cable 713 that is routed from the bottom of the master control lever 714 to the throttle control lever 715 of the carburetor. Only the float bowl 716 of the carburetor is visible in this view, as it is largely covered by plastic covers.

It should be understood that the level-wind mechanism of the first and second embodiments 100 and 200 can be grafted onto the compact alternate embodiment 500 of the powered winch retrieval system for harvested big game. This would involve removing the vertically-oriented and horizontally-oriented cable roller guides that are attached to the frame 601, increasing the height and depth of the frame 601 and installing the level-wind components, including sprockets 119 and 120, the roller chain 118, the grooved shaft 121, the level-wind tracking mechanism 124, and the guide shaft 127. It should also be understood that the sprockets and chains must be covered with protective guards to prevent the amputation of fingers. In addition, the speed-reduction and torque-amplification system of chains and sprockets, which effectively functions as a transmission, can be replaced by either a speed-reduction and torque-amplification system assembled from toothed belts and toothed wheels, or by an actual speed-reduction gearbox using at least one gear set. The use of such alternative speed reduction systems is well known in the mechanical arts, and all such devices should be considered as power transmission systems.

Although only three embodiments of the powered winch retrieval system for harvested big game has been shown and described herein, it will be obvious to those having ordinary skill in the art that changes and modifications may be made thereto without departing from the scope and the spirit of the invention as hereinafter claimed.

What is claimed is:

1. A powered winch retrieval system comprising:

a frame;

a single-cylinder internal combustion engine securely affixed to the frame, said engine having a throttle control lever, and a power output shaft;

a take-up shaft rotatably mounted on the frame;

a cable take-up spool concentrically mounted on the take-up shaft, said spool being rigidly affixable to the take-up shaft so that the spool can turn with the take-up shaft;

a game retrieval cable secured to and windable around the cable take-up spool;

a power transmission system, also mounted to the frame, which couples the output shaft to the take-up shaft and which provides speed reduction and torque amplification for the take-up shaft;

a disc brake rotor rigidly secured to the take-up shaft;

a brake caliper secured to the frame, said brake caliper having a caliper body enclosing a pair of brake pads which secure the brake rotor and prevent its rotation when the engine is idling, but allow the brake rotor to spin freely when the throttle control lever is moved to increase engine speed;

a master control lever that is spring biased toward a brake normally-applied position where the brake pads secure the brake rotor and prevent its rotation, and which, when moved from the brake normally-applied position, simultaneously releases pressure applied by the brake pads against the brake rotor and moves the throttle control lever by means of a Bowden cable to increase engine speed from idle; and a sliding coupler, mounted on the take-up shaft adjacent the take-up spool, that alternately enables both coupling and decoupling of take-up spool to the take-up shaft, thereby enabling the game retrieval cable, when the spool and shaft are in a decoupled state, to be unwound from the take-up spool while the take-up shaft remains stationary and, when in a coupled state, for the cable to be rewound onto the spool under power provided by the engine.

2. The powered winch retrieval system of claim 1, which further comprises an oscillating level-wind assembly which is powered by the engine, and which evenly winds the cable on the cable take-up spool.

3. The powered winch retrieval system of claim 2, wherein said level-wind assembly comprises:

a grooved shaft incorporating overlapping right-hand and left-hand grooves that are interconnected at both ends of the grooved shaft by a direction reversal loop, said grooved shaft being powered from the take-up shaft and rotating at about one-fifth the speed of the take-up shaft;

a cylindrical guide shaft that is parallel to both the grooved shaft and the take-up shaft;

an oscillating level-wind tracking mechanism which alternately tracks the right-hand and left-hand grooves on the grooved shaft, said level-wind tracking mechanism sliding on the cylindrical guide shaft, which prevents the tracking mechanism from rotating about the grooved shaft; and a cable guide incorporating a pair of horizontal rollers and a pair of vertical rollers, which form a frame around the cable and minimize abrasion thereto as it is unwound from and wound on the take-up spool.

4. The powered winch retrieval system of claim 3, wherein the level-wind tracking mechanism incorporates a linear ball-bearing bushing that slides over the cylindrical guide shaft and prevents binding between the level-wind tracking mechanism and the cylindrical guide shaft.

5. The powered winch retrieval system of claim 3, wherein the cylindrical guide shaft is made from hardened steel that is copper plated and, then, subsequently chrome plated.

6. The powered winch retrieval system of claim 1, wherein the master control lever, when moved from its brake normally-applied position, retracts a brake pad actuator wedge that is driven between an adjustable fixed post in the caliper body and a slidable post installed within the caliper body that presses against one of the brake pads.

7. The powered winch retrieval system of claim 1, which further comprises a centrifugal clutch, which couples the engine output shaft to the power transmission system.

8. The powererd winch retrieval system of claim 1, which further comprises a continuously-variable transmission (CVT), which couples the engine output shaft to the power transmission system, said CVT incorporating a centrifugal clutch that allows the engine to idle without engaging the power transmission system.

9. A powered winch retrieval system comprising:

a frame;

a single-cylinder internal combustion engine securely affixed to the frame, said engine having a throttle control lever, and a power output shaft;

a take-up shaft rotatably mounted on the frame;

a cable take-up spool concentrically mounted on the take-up shaft, said spool being rigidly affixable to the take-up shaft so that the spool can turn with the take-up shaft;

a game retrieval cable secured to and windable around the cable take-up spool;

a power transmission system, also mounted to the frame, which couples the output shaft to the take-up shaft and which provides speed reduction and torque amplification for the take-up shaft;

a disc brake rotor rigidly secured to the take-up shaft;

a brake caliper secured to the frame, said brake caliper having a caliper body enclosing a pair of brake pads which secure the brake rotor and prevent its rotation when the engine is idling, but allow the brake rotor to spin freely when the throttle control lever is moved to increase engine speed;

a sliding coupler, mounted on the take-up shaft adjacent the take-up spool, that alternately enables both coupling and decoupling of take-up spool to the take-up shaft, thereby enabling the game retrieval cable, when the spool and shaft are in a decoupled state, to be unwound from the take-up spool while the take-up shaft remains stationary and, when in a coupled state, for the cable to be rewound onto the spool under power provided by the engine; and an oscillating level-wind assembly which evenly winds the cable on the cable take-up spool, said level-wind assembly including a grooved shaft incorporating overlapping right-hand and left-hand grooves that are interconnected at both ends of the grooved shaft by a direction reversal loop, said grooved shaft being powered from the take-up shaft and rotating at about one-fifth the speed of the take-up shaft;

a cylindrical guide shaft that is parallel to both the grooved shaft and the take-up shaft;

an oscillating level-wind tracking mechanism which alternately tracks the right-hand and left-hand grooves on the grooved shaft, said level-wind tracking mechanism sliding on the cylindrical guide shaft, which prevents the tracking mechanism from rotating about the grooved shaft; and a cable guide incorporating a pair of horizontal rollers and a pair of vertical rollers, which form a frame around the cable and minimize abrasion thereto as it is unwound from and wound on the take-up spool;

wherein the level-wind tracking mechanism incorporates a linear ball-bearing bushing that slides over the cylindrical guide shaft and prevents binding between the level-wind tracking mechanism and the cylindrical guide shaft.

10. The powered winch retrieval system of claim 9, wherein the cylindrical guide shaft is made from hardened steel that is copper plated and, then, subsequently chrome plated.

11. The powered winch retrieval system of claim 9, which further comprises a master control lever that is spring biased toward a brake normally-applied position, and which, when moved from the brake normally-applied position, simultaneously releases pressure applied by the brake pads against the brake rotor and moves the throttle control lever by means of a Bowden cable to increase engine speed from idle.

12. The powered winch retrieval system of claim 11, wherein the master control lever, when moved from its brake normally-applied position, retracts a brake pad actuator wedge that is driven between an adjustable fixed post in the caliper body and a slidable post installed within the caliper body that presses against one of the brake pads.

13. The powered winch retrieval system of claim 9, which further comprises a centrifugal clutch, which couples the engine output shaft to the power transmission system.

14. The powererd winch retrieval system of claim 9, which further comprises a continuously-variable transmission (CVT), which couples the engine output shaft to the power transmission system, said CVT incorporating a centrifugal clutch that allows the engine to idle without engaging the power transmission system.

* * * * *